US010789936B2

(12) United States Patent
Lewis et al.

(10) Patent No.: US 10,789,936 B2
(45) Date of Patent: Sep. 29, 2020

(54) ACTIVE NOISE CONTROL FOR HYDRAULIC FRACTURING EQUIPMENT

(71) Applicant: Halliburton Energy Services, Inc., Houston, TX (US)

(72) Inventors: Bryan John Lewis, Duncan, OK (US); Kenneth R. Coffman, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/331,890

(22) PCT Filed: Dec. 29, 2016

(86) PCT No.: PCT/US2016/069108

§ 371 (c)(1),
(2) Date: Mar. 8, 2019

(87) PCT Pub. No.: WO2018/125116

PCT Pub. Date: Jul. 5, 2018

(65) Prior Publication Data

US 2019/0213992 A1 Jul. 11, 2019

(51) Int. Cl.
*G10K 11/178* (2006.01)

(52) U.S. Cl.
CPC .. *G10K 11/17883* (2018.01); *G10K 2210/121* (2013.01); *G10K 2210/129* (2013.01)

(58) Field of Classification Search
CPC ..... G10K 11/17883; G10K 2210/121; G10K 2210/129; G10K 11/178; G10K 11/17881; G10K 2210/3216
See application file for complete search history.

(56) References Cited

U.S. PATENT DOCUMENTS

| | | | |
|---|---|---|---|
| 5,359,662 | A | 10/1994 | Yuan et al. |
| 5,448,645 | A | 9/1995 | Guerci |
| 5,618,010 | A | 4/1997 | Pla et al. |
| 5,689,437 | A | 12/1997 | Finn |
| 6,343,127 | B1 | 1/2002 | Billoud |
| 6,917,687 | B2 | 7/2005 | Vaishya |
| 6,940,983 | B2 | 9/2005 | Stuart |

(Continued)

FOREIGN PATENT DOCUMENTS

| | | | |
|---|---|---|---|
| WO | 1993/011529 | A1 | 6/1993 |
| WO | 2014176133 | A1 | 10/2014 |

OTHER PUBLICATIONS

International Search Report & Written Opinion issued for corresponding International Application No. PCT/US2016/069108 dated Sep. 5, 2017 (14 pages).

*Primary Examiner* — Jason R Kurr
(74) *Attorney, Agent, or Firm* — McGuirewoods, LLP

(57) ABSTRACT

A method for noise attenuation includes comparing a frequency of noise generated by a plurality of noise sources with a plurality of frequencies associated with a pre-determined noise spectrum and stored in a computer system, identifying one or more noise sources that generate the noise based on the comparison of the frequency of the noise and the plurality of frequencies stored in the computer system; generating anti-noise corresponding to the noise; and outputting the anti-noise using one or more noise mitigation devices associated with the one or more noise sources.

17 Claims, 4 Drawing Sheets

(56) References Cited

U.S. PATENT DOCUMENTS

| | | | | |
|---|---|---|---|---|
| 6,990,419 | B2 | 1/2006 | Ramillon et al. | |
| 7,272,234 | B2 | 9/2007 | Sommerfeldt et al. | |
| 8,068,616 | B2 | 11/2011 | Copley et al. | |
| 8,270,625 | B2 | 9/2012 | Sommerfeldt et al. | |
| 9,025,786 | B2 | 5/2015 | Luecking et al. | |
| 2003/0198354 | A1 | 10/2003 | Stuart | |
| 2006/0056642 | A1* | 3/2006 | Inoue | G10K 11/178 381/71.11 |
| 2009/0003617 | A1* | 1/2009 | Goldman | G10K 11/178 381/71.12 |
| 2012/0288112 | A1* | 11/2012 | Yang | G10K 11/178 381/71.8 |
| 2013/0166076 | A1 | 6/2013 | Karr | |
| 2017/0193975 | A1* | 7/2017 | Butts | G10L 21/0216 |

* cited by examiner

ACTIVE NOISE CONTROL FOR HYDRAULIC FRACTURING EQUIPMENT

BACKGROUND

Heavy machinery such as hydraulic fracturing equipment (e.g., high-pressure pumps, blenders, pneumatic conveyers) used in the oil and gas industry typically emit high levels of noise ranging from about 85 dB to about 115 db. This noise (or sound, in general) propagates in the form pressure waves, which consist of a compression phase and a rarefaction phase. High noise levels pose potential health risks to oilfield workers and the public.

One way to attenuate the noise generated by the machinery is to modify the design of the most significant noise producing components, such as engines, exhaust, fans, and gearboxes of the machinery. Another way to attenuate the noise is to enclose the machinery within an acoustic enclosure consisting of noise absorbing material that absorbs sound waves generated by the machinery and prevent the propagation of the sound waves away from the machinery. Additionally, noise can be attenuated by placing sound walls or noise barriers around the perimeter of the job site or by placing portable sound absorption panels between the machinery and human personnel or sensitive areas.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
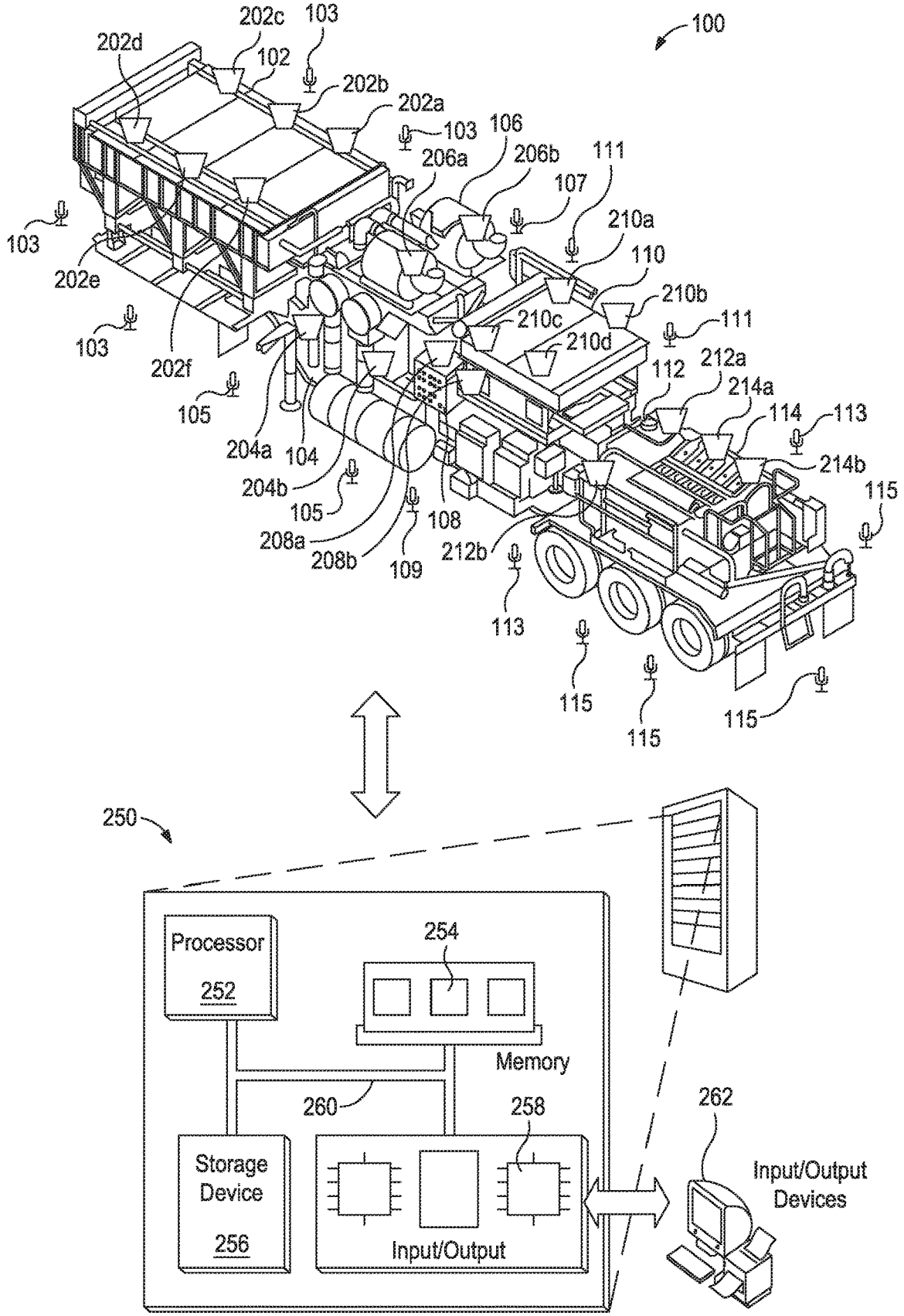
FIG. 1A is a schematic diagram of a high-pressure pumping unit used in hydraulic fracturing operations.

Embodiments disclosed are directed to active noise attenuation techniques for obtaining a global attenuation of the noise generated by machinery. Noise may generally refer to any undesirable sound or acoustic propagation produced by the machinery. Each component of the machinery may produce noise that may propagate as a pressure wave having a frequency, amplitude, and phase specific to the noise generating component.

The active noise attenuation techniques disclosed herein use noise detection devices to detect noise generated by individual noise generating components of the machinery and produce anti-noise using one or more noise mitigation devices positioned proximate each individual noise generating component. The generated anti-noise is specific to the target noise to be attenuated and has an amplitude and frequency similar to or the same as the amplitude and frequency of the target noise, but with a phase shift of about 180° compared to the target noise. When combined, the target noise and the anti-noise destructively interfere and the target noise is thereby attenuated.

As used herein, the term "machinery" and any variation thereof refers to heavy duty machinery or heavy moving machinery, such as machinery used in earth moving, construction, or forestry, agricultural machines, hydraulic fracturing equipment and other oilfield equipment, mining equipment, heavy duty trucks, engineering equipment, heavy hydraulics, any combination thereof, and the like. The term "machinery" and any variation thereof also refers to other machinery, such as automobile engines, transmissions, portable generators, any combination thereof, and the like. The embodiments described herein are directed primarily to attenuating noise generated by multiple machinery located adjacent each other in an open air environment in which there are no enclosures around the machinery. This is in contrast to existing noise attenuation techniques that are predominately directed to attenuating noise generated by noise sources located in a closed environment not exposed to the atmosphere. An example of a closed environment is the passenger cabin of a vehicle and the noise attenuation techniques attenuate the noise inside the passenger cabin. Multiple machinery operating in close proximity of each other causes noise generated by adjacent heavy duty machinery to reflect or bounce off each other. As a result, locating individual noise sources is difficult and less predictable as compared to noise sources located in a defined, confined space.

Embodiments described herein are directed to detecting the noise generated by individual noise sources located in an open air environment and in close proximity of each other.

For the sake of explanation, embodiments are described with reference to attenuating noise generated by hydraulic fracturing equipment, such as frac blenders to combine chemicals, base fluid and proppant into specific mixes of fracturing fluids, high-horsepower frac pumps, high-horsepower engines for running the machinery, exhaust units, transmission units, cooling units, slurry mixers, and the like. However, it should be noted that embodiments disclosed herein are equally applicable to attenuating noise generated by other types of heavy machinery, without departing from the scope of the disclosure.

As used herein, the term "global noise attenuation" and any variation thereof refers to noise attenuation that is performed independent of the location at which the noise attenuation is desired or measured. Thus, in the case of heavy machinery operating in an open-air environment and generating noise, global noise attenuation may result in the noise being attenuated substantially at any and all locations around the heavy machinery. Stated otherwise, the resulting noise attenuation may be omnidirectional. This is in contrast to local noise attenuation in which the noise level at a predetermined or preset (specific) location around the noise source is attenuated. In this case, the noise attenuation techniques may be employed at or around the preset location. As an example, the location may be an operator compartment of a vehicle.

As used herein, the term "active noise attenuation" and any variation thereof refers to a method for attenuating noise by the addition of anti-noise specifically designed to attenuate the noise. The active noise reduction is a dynamic process, wherein a variation in the characteristic (e.g., amplitude, frequency, and phase) of the noise produces a real-time, or near real-time, dynamic variation in the anti-noise to cause destructive interference between the noise and the anti-noise. In contrast, passive noise attenuation techniques attenuate a preset or predetermined range of frequencies and the passive noise attenuation techniques cannot be adapted to attenuate frequencies that may arise during operation.

FIG. 1A is an isometric view of an example high-pressure pumping unit 100 used in hydraulic fracturing operations. The high-pressure pumping unit 100 may be used to pump high pressure fracturing fluid into a wellbore during hydraulic fracturing operations. As illustrated, seven distinct potential noise sources (or noise producing components) may be generally identified in the high-pressure pumping unit 100. The potential noise sources may be or include a water cooler unit 102, an engine unit 104, an exhaust 106, a transmission unit 108, an air-cooling unit 110, a speed controller 112, and a pumping unit 114. It should be understood, however, that the number of potential noise sources in the high-pressure pumping unit 100 is merely an example, and more or less potential noise sources may be present. It should also be noted that FIG. 1A may not indicate the exact location of the noise sources, but may depict the general location of the potential noise sources of the high-pressure pumping unit 100.

Figure 1B:
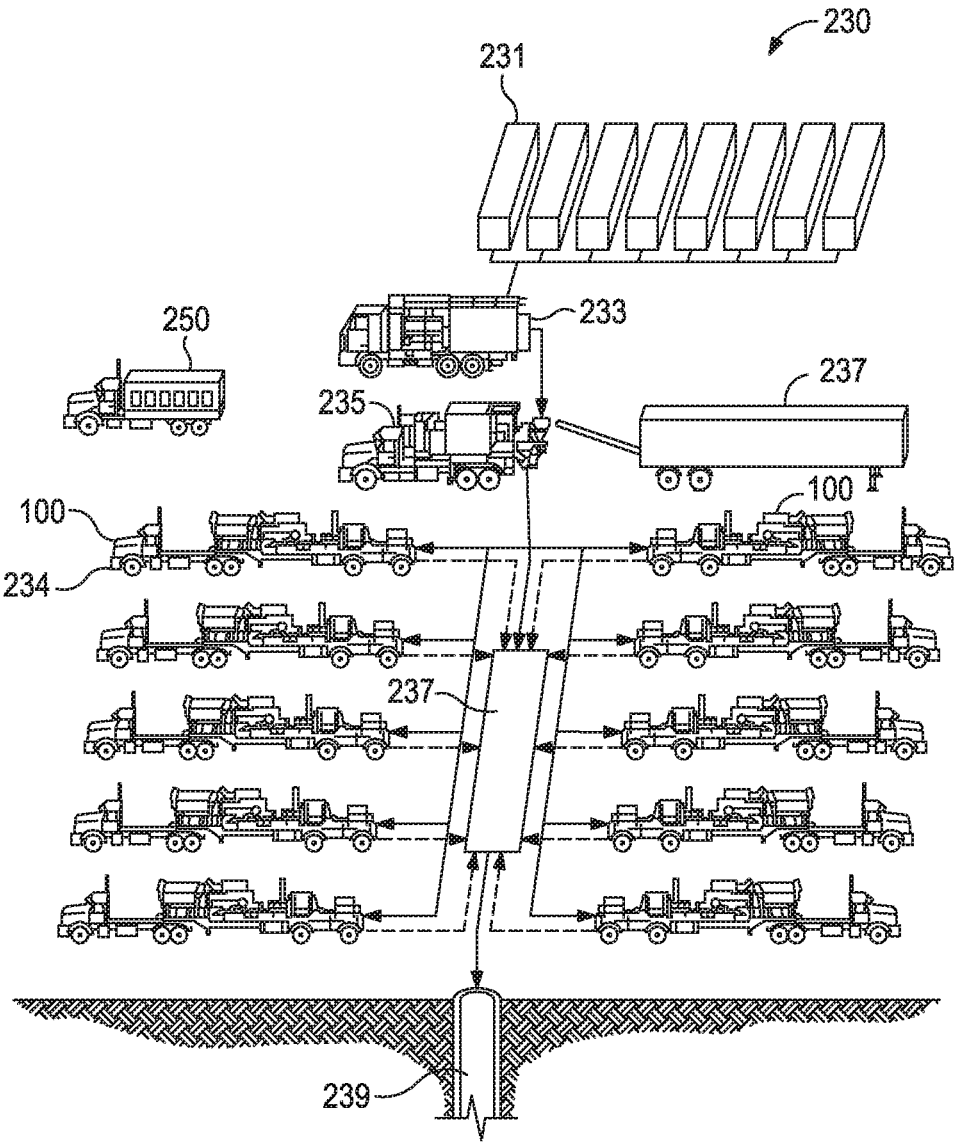
FIG. 1B illustrates a pump system used in hydraulic fracturing operations and including multiple high-pressure pumping units of FIG. 1A.

Typically, hydraulic fracturing operations include multiple high-pressure pumping units 100 operating in close proximity of each other. Referring briefly to FIG. 1B, illustrated is a pump system 230 used in hydraulic fracturing operations and that includes multiple high-pressure pumping units 100. Each high-pressure pumping units 100 may be transported using a tractor 234. The pump system 230 may further include a plurality of water tanks 231 that feed water to a gel maker 233. The gel maker 233 may combine water from the tanks 231 with a gelling agent to form a gel. The gel is then sent to a blender 235 where it is mixed with a proppant from a proppant feeder 237 to form fracturing fluid.

The fracturing fluid is then supplied from the blender 235 to a plurality of high-pressure pumping units 100. Each high-pressure pumping unit 100 receives the fracturing fluid and discharges it to a common manifold 237 at a high pressure. The manifold 237 then directs the fracturing fluid from the high-pressure pumping units 100 to the wellbore 239.

As will be understood from FIG. 1B, multiple high-pressure pumping units 100 operate in close proximity with each other, and as a result, the noise generated by each high-pressure pumping unit 100 interferes with the noise from the other high-pressure pumping units 100. In addition, the reflection of the noise from adjacent high-pressure pumping units 100 results in a very complex noise spectrum. Additionally, the noise spectrum also includes the noise from the high-pressure pumping units 100 that interacts with the noise generated by the gel maker 233, blender 235, proppant feeder 237, and other equipment included in the pump system 230. The example method disclosed herein for mitigating the noise generated by the high-pressure pumping units 100 may be equally applicable to mitigating the noise generated by the gel maker 233, blender 235, proppant feeder 237, and other equipment included in the pump system 230.

Returning to FIG. 1A, each noise source may produce noise having specific (or unique) characteristics (e.g., amplitude, frequency, and phase) detectable using one or more noise detection device placed adjacent the noise sources. In an example and as illustrated, the one or more noise detection devices may be or include microphones 103, 105, 107, 109, 111, 113, and 115 positioned adjacent the respective noise sources 102, 104, 106, 108, 110, 112, and 114. However, other noise detection devices that directly or indirectly detect noise may also be used without departing from the scope of the disclosure. In an embodiment, the microphones may be configured to detect noise generated from a specific noise source. For example, microphones 103 may be configured to detect noise generated from the water cooler 102, microphones 105 may be configured to detect noise generated from the engine unit 104, and so on. However, in other embodiments, one or more microphones may be configured to detect noise generated by two or more noise sources, such as acoustically overlapping noise sources. The noise generated by a particular noise source 102, 104, 106, 108, 110, 112, and 114 may be attenuated using anti-noise specifically designed for that noise. As mentioned above, the anti-noise may have an amplitude and frequency about the same as the amplitude and frequency of the target noise, but with a phase shift of around 180° as compared to the target noise.

The anti-noise may be output (generated) using one or more noise mitigation devices associated with each noise source. Specifically, the associated noise mitigation devices may be specific to the noise source and may be positioned or otherwise installed proximate each noise source such that the anti-noise produced by these associated noise mitigation devices interacts with and thereby mitigates the noise in all directions relative to the noise source. The noise mitigation devices may thus be positioned or otherwise arranged 360° around the noise source. In an example, the noise mitigation devices may be positioned such that the anti-noise generated by the noise mitigation devices destructively interferes with the noise generated by the noise sources from all directions relative to the noise sources to thereby attenuate the noise.

The noise mitigation devices may thus be positioned in a variety of configurations including, for example, a generally hemispherical or dome type structure enclosing or otherwise covering the high-pressure pumping unit 100. In other examples, the noise mitigation devices may be positioned in the form of an array that encloses or otherwise covers the high-pressure pumping unit 100 and is representative of the geometric configuration of the high-pressure pumping unit 100. In an example, the noise mitigation devices may be positioned around the noise sources via stands placed in the surrounding ground. In other examples, the noise mitigation devices may be suspended in the air around/about the noise sources. In yet other examples, the noise mitigation devices may be installed on the high-pressure pumping unit 100 via mounting brackets, and, as a result, may be a part of the high-pressure pumping unit 100.

In an example and as illustrated, the noise mitigation devices may be or include speakers 202*a*-202*f*, 204*a*-204*b*, 206*a*-206*b*, 208*a*-208*b*, 210*a*-210*d*, 212*a*-212*b*, and 214*a*-214*b*, each being positioned proximate respective noise sources 102, 104, 106, 108, 110, 112, and 114. However, other noise mitigation devices, such as active vibrating panels, dynamic acoustic dampeners, or a combination thereof and the like, may also be used without departing from the scope of the disclosure.

For the sake of simplicity, the speakers 202*a*-202*f*, 204*a*-204*b*, 206*a*-206*b*, 208*a*-208*b*, 210*a*-210*d*, 212*a*-212*b*, and 214*a*-214*b* are illustrated positioned on only a side (e.g., a lateral side or a top side) of each respective component. However, as mentioned above, the speakers may surround the respective noise sources from any and all possible directions so that the anti-noise output therefrom interferes with the noise from the respective noise sources from all possible directions. For instance, with reference to the water cooler unit 102, in addition to speakers 202*a*-202*f* positioned on top thereof, speakers may also be positioned to the left and right, in the front and rear, and below the water cooler unit 102. Similarly, additional speakers may be positioned proximate the other noise sources 104, 106, 108, 110, 112, and 114. It should be noted that the number of speakers 202*a*-202*f*, 204*a*-204*b*, 206*a*-206*b*, 208*a*-208*b*, 210*a*-210*d*, 212*a*-212*b*, and 214*a*-214*b* illustrated in FIG. 1A is merely an example, and that the number may be increased or decreased based on the intensity of the noise produced from the noise sources, the number of noise sources, the distribution of the noise sources, and other application and design parameters.

The speakers 202*a*-202*f*, 204*a*-204*b*, 206*a*-206*b*, 208*a*-208*b*, 210*a*-210*d*, 212*a*-212*b*, and 214*a*-214*b* may be controlled/driven by a computer system 250 in communication with the high-pressure pumping unit 100. Specifically, the computer system 250 may be configured to receive one or more signals based on to the noise detected by the microphones 103, 105, 107, 109, 111, 113, and 115 (or any other noise detection devices used), generate corresponding anti-noise signals, and control (operate) the corresponding speakers 202*a*-202*f*, 204*a*-204*b*, 206*a*-206*b*, 208*a*-208*b*, 210*a*-210*d*, 212*a*-212*b*, and 214*a*-214*b* to output the anti-noise. Because the anti-noise is produced specific to a given (target) noise, the computer system 250 may be configured to drive the speakers 202*a*-202*f*, 204*a*-204*b*, 206*a*-206*b*, 208*a*-208*b*, 210*a*-210*d*, 212*a*-212*b*, and 214*a*-214*b* to generate anti-noise specific to the noise detected by the corresponding microphones 103, 105, 107, 109, 111, 113, and 115. For example, the computer system 250 drives the speakers 202*a*-202*f* to generate the anti-noise that attenuates the noise detected by the microphone(s) 103, drives the speakers 204*a*-204*b* to generate the anti-noise that attenuates the noise detected by the microphone(s) 105, and so on.

The computer system 250 may be located at or near the high-pressure pumping unit 100, or may alternatively form an integral part of the high-pressure pumping unit 100. In other embodiments, the computer system 250 may be located at a remote location and able to control the speakers 202*a*-202*f*, 204*a*-204*b*, 206*a*-206*b*, 208*a*-208*b*, 210*a*-210*d*, 212*a*-212*b*, and 214*a*-214*b* via wired or wireless telecommunication means. Referring briefly to FIG. 1B, the computer system 250 may control the overall operation of the pump system 230. Alternatively, each high-pressure pumping unit 100 of the pump system 230 may be controlled by an individual computer system that may be the same as or similar to the computer system 250 and may communicate with the computer systems of other high-pressure pumping units 100 via wired or wireless communication means.

Returning to FIG. 1A, the computer system 250 may include a processor 252, computer-readable storage mediums such as memory 254 and storage device 256, and an input/output device 258. Each of the components 252, 254, 256, and 258 may be interconnected, for example, using a system bus 260. The processor 252 may be processing instructions for execution within the computer system 250. In some embodiments, the processor 252 is a single-threaded processor, a multi-threaded processor, a system on a chip, a special purpose logic circuitry, e.g., an FPGA (field programmable gate array) or an ASIC (application specific integrated circuit), or another type of processor. The processor 252 may be capable of processing computer program code stored in the memory 254 or on the storage device 256. The memory 254 and the storage device 256 include non-transitory mediums such as random access memory (RAM) devices, read only memory (ROM) devices, optical devices (e.g., CDs or DVDs), semiconductor memory devices (e.g., EPROM, EEPROM, flash memory devices, and others), magnetic disks (e.g., internal hard disks, removable disks, and others), and magneto optical disks.

The input/output device 258 may provide input/output operations for the computer system 250. In some embodiments, the input/output device 258 can include one or more network interface devices, e.g., an Ethernet card; a serial communication device, e.g., an RS-232 port; and/or a wireless interface device, e.g., an 802.11 card, a 3G wireless modem, or a 4G wireless modem. In some embodiments, the input/output device 258 can include driver devices configured to receive input data and send output data to other input/output devices 262 including, for example, a keyboard, a pointing device (e.g., a mouse, a trackball, a tablet, a touch sensitive screen, or another type of pointing device), a printer, and display devices (e.g., a monitor, or another type of display device) for displaying information to a user. Other kinds of devices can be used to provide for interaction with the user as well; for example, feedback provided to the user can be any form of sensory feedback, e.g., visual feedback, auditory feedback, or tactile feedback; and input from the user can be received in any form, including acoustic, speech, or tactile input. In some embodiments, mobile computing devices, mobile communication devices, and other devices can be used.

The computer system 250 may include a single processing system, or may be a part of multiple processing systems that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective processing systems and having a client-server relationship to each other.

To effectively attenuate noise produced by a noise source, it may be required to position each speaker at or within a specific distance from an associated or corresponding noise source. This distance may be determined based on the wavelength of the noise produced by the noise source. Specifically, for effective global noise attenuation, each speaker is positioned from an associated noise source at or within a distance that is half of the shortest wavelength (alternatively, the highest frequency) of noise produced from the noise source. As an example, assuming that the velocity of sound in air is around 340 meters per second (m/s), if the primary frequency of the noise generated from the water cooler unit 102 is around 30 Hz, then the wavelength of such noise is around 11.334 meters (m). Accordingly, each speaker 202*a*-202*f* associated with the water cooler unit 102 may be placed at a distance no more than around 5.667 m (i.e., 11.334/2) from the water cooler unit 102. As another example, again assuming that the velocity of sound in air is around 340 m/s, if the frequency of the noise generated from the transmission unit 108 is around 1000 Hz, then the wavelength of the noise is around 0.34 m and each speaker 204*a*-204*b* may be placed at a distance no more than around 0.17 m (i.e., 0.34/2) from the engine unit 104.

In addition, adjacent speakers associated with (or corresponding to) the same noise source may be separated from each other with a distance that is less than or equal to half the shortest wavelength of the noise produced from the noise source. Thus, as an example, the distance between the adjacent speakers of the speakers 202*a*-202*f* associated with the water cooler unit 102 may be equal to or less than half of the wavelength of the noise generated by the water cooler unit 102. Such separation between adjacent speaker 202*a*-202*f* may amplify the anti-noise produced by the speakers 202*a*-202*f*. As a result, the amplitude of the anti-noise generated by the speakers 202*a*-202*f* may be reduced. Thus, the size and power requirements of the speakers 202*a*-202*f* may be reduced as well.

Embodiments contemplated herein may implement the active noise attenuation techniques disclosed above in combination with passive noise attenuation techniques to provide improved noise attenuation. Passive noise attenuation techniques can be effective for mitigating noise frequencies greater than 1000 Hz. On the other hand, active noise attenuation techniques are more effective for mitigating noise frequencies less than 1000 Hz. Passive noise attenuation may be obtained by enclosing (i.e., surrounding, encasing, enveloping, etc.) one or more of the noise sources 102, 104, 106, 108, 110, 112, and 114 with sound absorbent (or soundproofing) materials to absorb or minimize noise reflecting back to the noise source. Either each noise source 102, 104, 106, 108, 110, 112, and 114 may be individually enclosed with sound absorbent (or soundproofing) materials or two or more noise sources 102, 104, 106, 108, 110, 112, and 114 may be together enclosed with sound absorbent (or soundproofing) materials. Examples of sound absorbent materials may include drywall (e.g., sheetrock), damped drywall (drywall incorporating a sound damping layer), sound-deadening fiberboard (also called soundboard or acoustical board), mass-loaded vinyl (MLV), insulation (e.g., fiberglass, mineral wool, foam, etc.), sound curtains, damping compounds (e.g., viscoelastic adhesive), acoustical sealant (e.g., acoustical caulk), a combination thereof and the like.

In some embodiments, the flow path of the airflow or other exhaust from one or more noise sources 102, 104, 106, 108, 110, 112, and 114 may be modified to attenuate the generated noise. In other embodiments, additional noise barriers such as a masonry wall or earthwork, or a combination thereof (e.g., a wall atop an earth berm) may also be used. Active noise attenuation techniques, according to the embodiments disclosed, may then be used (or employed) to attenuate the low frequency noise that may not be attenuated using passive noise attenuation techniques. Thus, when using a combination of active and passive noise attenuation techniques, the noise (sound waves) generated by the noise source initially encounters the passive noise attenuation techniques and then encounters the active noise attenuation techniques.

Various pieces of equipment of the high-pressure pumping unit 100 can include rotating component parts that rotate in generating the target noise. For example, rotating component parts may be or include fans, engines, transmissions, centrifugal pumps, volumetric pumps, vacuum pumps and compressors, turbines, ventilators, centrifuges, motors, gearboxes, mixing gears, and the like. Rotating component parts can be included, for instance, in the engine unit 104, the transmission unit 108, the speed controller 112, and/or the pumping unit 114. Rotational sensors (alternatively referred to as "speed sensors") may be used to determine the frequency of the noise generated by such rotating component parts and, as such, the frequency of the noise generated by the equipment including the rotating component parts. The rotational sensors may be or include magnetic sensors, optical sensors, a combination thereof, and the like.

Accordingly, in some embodiments, the microphones 105, 109, 113, and 115 may be replaced by (or complimented with) corresponding rotational sensors (not explicitly illustrated). One or more rotational sensors may be coupled to the rotating component parts (e.g., coupled to the shaft, gears, spindles, and the like of the rotating component parts) and may measure a rotational speed and an angular position of the rotating component parts. The computer system 250 may store pre-determined noise spectra of the noise generated by each rotating component part for different values of the rotational speed of the rotating component part. Each noise spectrum includes the amplitude of the noise for different values of frequency for a given rotational speed of the rotating component part. The rotational speed is thus indicative of the frequency of the noise generated by each rotating component part.

During operation, the measured rotational speed is compared with the stored rotational speed to obtain the noise spectrum corresponding to the measured rotational speed. The frequency and amplitude of the anti-noise to be generated is determined from the noise spectrum and the computer system 250 may drive the speakers 204*a*-204*b*, 208*a*-208*b*, 212*a*-212*b*, and 214*a*-214*b* associated with the noise source including the rotating component part to generate the corresponding anti-noise. The anti-noise generated may be shifted in phase based on the angular position measured by the rotational sensors.

It should be noted that the measured rotational speed may not exactly match the stored rotational speed. The measured rotational speed may be considered to match the stored rotational speed when a difference between the measured and stored rotational speeds is less than a pre-determined value (e.g., determined based on a desired standard deviation).

Figure 2:
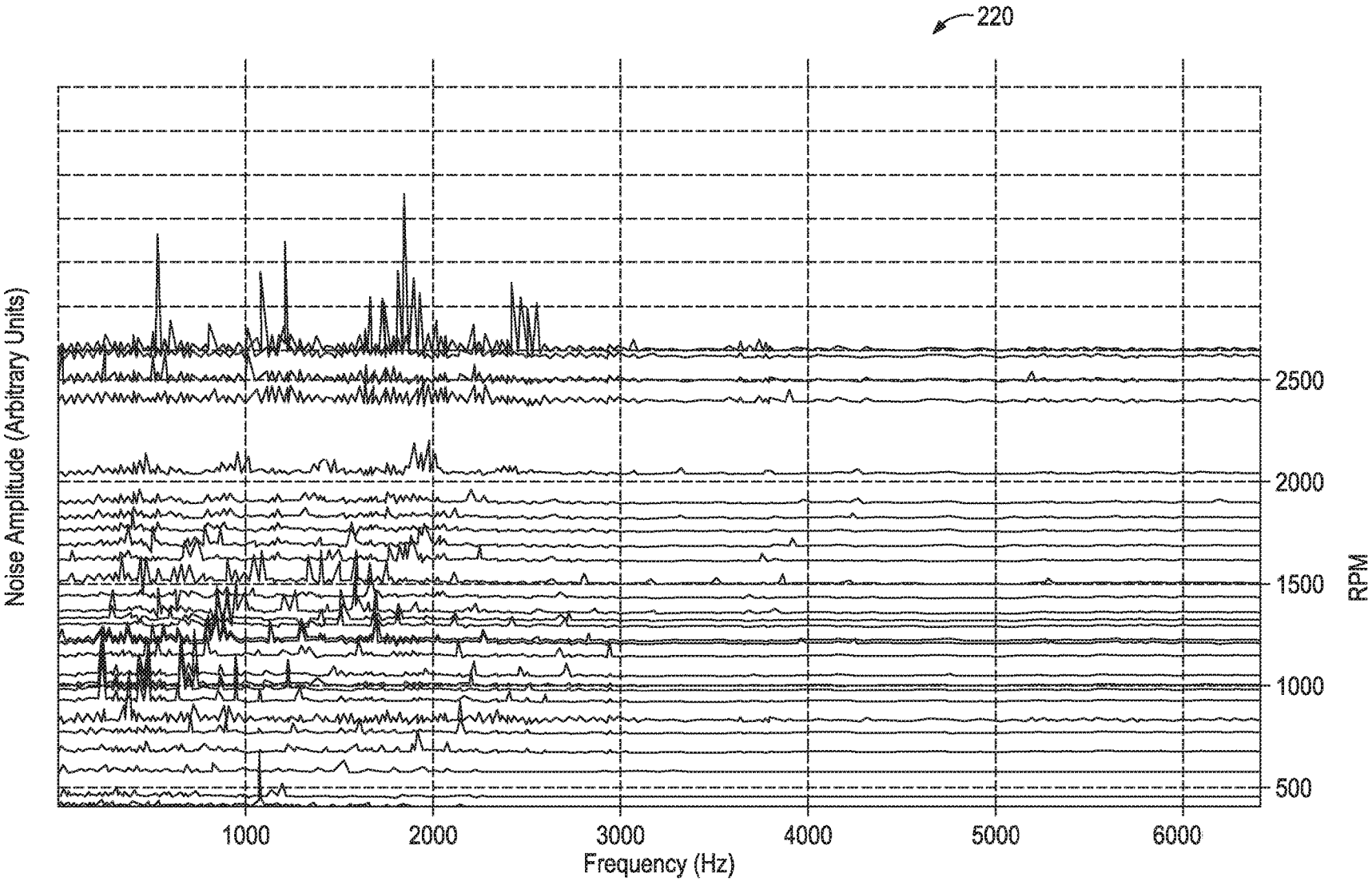
FIG. 2 illustrates example noise spectra of the noise generated by a noise source of the high-pressure pumping unit of FIG. 1A for different rotational speeds of the noise source.

FIG. 2 illustrates example noise spectra 220 of the noise generated by a noise source of the high-pressure pumping unit 100 of FIG. 1A for different rotational speeds of the noise source. The noise source may be one of the noise sources 102, 104, 106, 108, 110, 112, and 114 of the high-pressure pumping unit 100. During operation, and as discussed above, the measured rotational speed from the rotational sensors is matched with the different RPM values to obtain the corresponding noise spectrum. The computer system 250 may drive the speakers 204*a*-204*b*, 208*a*-208*b*, 212*a*-212*b*, and 214*a*-214*b* to generate the corresponding anti-noise.

In other embodiments, instead of using multiple microphones 103, 105, 107, 109, 111, 113, and 115 (FIG. 1A), a single microphone may be used to detect noise generated by two or more of the noise sources 102, 104, 106, 108, 110, 112, and 114 (FIG. 1A). In such embodiments, a predetermined noise spectrum of the noise generated by the high-pressure pumping unit 100 may be stored in the computer system 250 (FIG. 1A). The noise spectrum thus includes the noise from all noise sources 102, 104, 106, 108, 110, 112, and 114 of the high-pressure pumping unit 100. The noise spectrum may be compared with the noise detected by the single microphone to generate the corresponding anti-noise signal.

Figure 3:
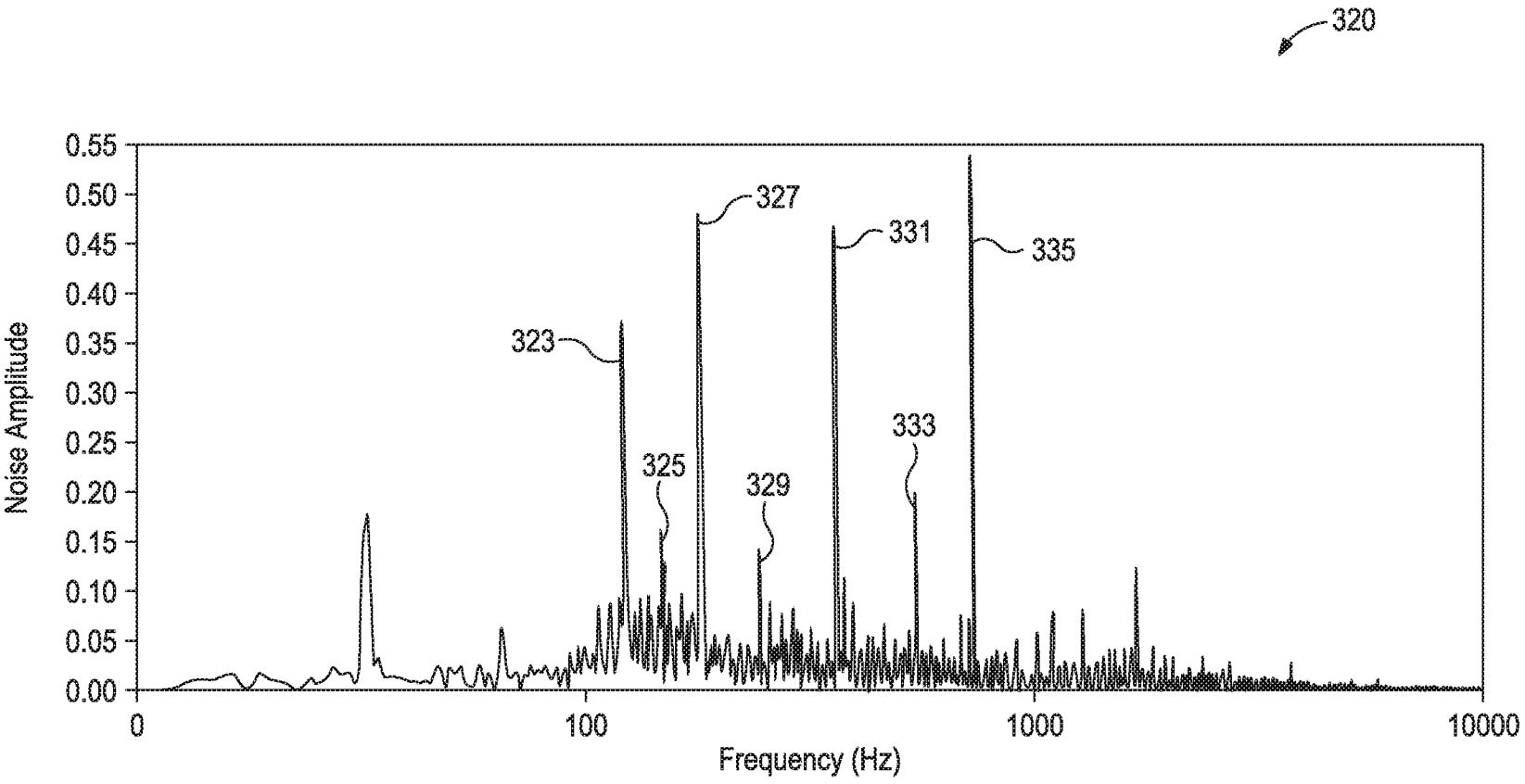
FIG. 3 illustrates an example noise spectrum obtained of the noise generated by the high-pressure pumping unit of FIG. 1A for a given operational characteristic of its one or more noise sources.

FIG. 3 illustrates an example noise spectrum 320 obtained based on the noise generated by the high-pressure pumping unit 100 of FIG. 1A for a given operational characteristic of the one or more noise sources 102, 104, 106, 108, 110, 112, and 114. For instance, the noise spectrum 320 may be obtained when the engine unit 104 rotates at about 1900 RPM.

The noise spectrum 220 includes multiple peaks 323, 325, 327, 329, 331, 333, and 335, which are indicative of the noise frequencies having the highest amplitudes. For instance, these noise frequencies may correspond to the noise generated by the noise sources 102, 104, 106, 108, 110, 112, and 114. The anti-noise may be then generated for these noise frequencies.

Noise may be expressed as $S(t)=A*\sin(\omega t+\varphi)$, where A represents the amplitude of the noise, $\omega=2\pi f$ represents the frequency of the noise, and $\varphi$ represents the phase of the noise. In the noise mitigation techniques, according to embodiments disclosed, the single microphone detects the noise generated by the high-pressure pumping unit 100. The computer system 250 processes the noise (e.g., using a spectral analyzer) to determine the amplitude and frequency of the noise. The phase may be calculated using feed forward algorithms and other known iterative methods.

The computer system 250 compares the detected noise against the noise spectrum 320 stored therein. Based on the comparison, the computer system 250 may identify the noise source(s) generating the noise and generate the corresponding anti-noise having the determined amplitude and frequency, and a phase that is shifted about 180° from the calculated phase. The computer system 250 may drive the speakers 202*a*-202*f*, 204*a*-204*b*, 206*a*-206*b*, 208*a*-208*b*, 210*a*-210*d*, 212*a*-212*b*, and 214*a*-214*b* associated with the identified noise source to output the anti-noise.

In certain instances, there may be a shift in the frequency of noise as received by the computer system 250. This shift may be due to error in transmission of the detected noise, error in processing of the received noise, etc. Accordingly, in some embodiments, the computer system 250 may compare the received frequency with a range of possible noise frequencies in the noise spectrum 220 and may determine the noise source based on the comparison (e.g., based on a pre-determined standard deviation). The computer system 250 may then drive the corresponding speakers 202*a*-202*f*, 204*a*-204*b*, 206*a*-206*b*, 208*a*-208*b*, 210*a*-210*d*, 212*a*-212*b*, and 214*a*-214*b* to output the corresponding anti-noise.

Examples disclosed herein include:

A. A method for noise attenuation, comprising comparing a frequency of noise generated by a plurality of noise sources with a plurality of frequencies associated with a pre-determined noise spectrum and stored in a computer system; identifying one or more noise sources that generate the noise based on the comparison of the frequency of the noise and the plurality of frequencies stored in the computer system; generating anti-noise corresponding to the noise; and outputting the anti-noise using one or more noise mitigation devices associated with the one or more noise sources.

B. A system for noise attenuation, comprising a plurality of noise mitigation devices for outputting anti-noise corresponding to noise generated by a plurality of noise sources; and a computer system including a non-transitory medium readable by a processor and storing computer-readable instructions that when executed by the processor configures the computer system to: compare a frequency of the noise with a plurality of noise frequencies associated with a pre-determined noise spectrum and stored in the computer system, identify one or more noise sources that generate the noise based on the comparison of the frequency of the noise and the plurality of frequencies stored in the computer system, generate the anti-noise corresponding to the noise, and actuate one or more noise mitigation devices associated with the one or more noise sources to output the anti-noise.

C. A computer program product embodied in a non-transitory computer-readable medium and comprising a computer readable program code that, when executed by a computer system, causes the computer system to: compare a frequency of noise generated by a plurality of noise sources with a plurality of noise frequencies associated with a pre-determined noise spectrum and stored in the computer system; identify one or more noise sources that generate the noise based on the comparison of the frequency of the noise and the plurality of frequencies stored in the computer system; generate anti-noise corresponding to the noise; and actuate one or more noise mitigation devices associated with the one or more noise sources to output the anti-noise.

Each of examples A, B, and C may have one or more of the following additional elements in any combination: Element 1: further comprising detecting the noise using one or more noise detection devices.

Element 2: wherein a noise source of the plurality of noise sources comprises rotating equipment, the pre-determined noise spectrum pertains to a plurality of pre-determined noise spectra stored in the computer system, and each pre-determined noise spectra includes frequencies generated by the noise source at different rotational speeds, the method further comprising: measuring a rotational speed of the noise source using a rotational sensor; and comparing the measured rotational speed with the different rotational speeds in the noise spectrum and thereby determining a frequency of the noise source. Element 3: further comprising positioning the one or more noise mitigation devices proximate each noise source such that the anti-noise destructively interferes with the noise in some or all directions relative to the plurality of noise sources to thereby attenuate the noise. Element 4: wherein the plurality of noise sources comprises heavy machinery located in an open air environment. Element 5: wherein each noise mitigation device is associated with a corresponding one of the plurality of noise sources and outputting the anti-noise further comprises outputting anti-noise with each noise mitigation device specific to the noise generated by the corresponding one of the plurality of noise sources. Element 6: wherein each noise mitigation device is associated with a corresponding one of the plurality of noise sources and the method further comprises: positioning each noise mitigation device associated with corresponding one of the plurality noise sources at a distance less than or equal to half of a shortest wavelength of the noise generated by the corresponding one of the plurality noise sources.

Element 7: further comprising one or more noise detection devices. Element 8: wherein a noise source of the plurality of noise sources comprises rotating equipment, the pre-determined noise spectrum pertains to a plurality of pre-determined noise spectra stored in the computer system, and each pre-determined noise spectra includes noise frequencies generated by the noise source at different rotational speeds, and wherein the computer system is configured to: obtain a rotational speed of the noise source measured using a rotational sensor; and compare the measured rotational speed with the different rotational speeds in the noise spectrum and thereby determine a frequency of the noise source. Element 9: wherein the plurality of noise mitigation devices are positioned proximate each noise source such that the anti-noise destructively interferes with the noise in some or all directions relative to the plurality of noise sources to thereby attenuate the noise. Element 10: wherein the plurality of noise sources comprises heavy machinery located in an open air environment. Element 11: wherein each noise mitigation device is associated with a corresponding one of the plurality of noise sources and the computer system actuates each noise mitigation device to output the anti-noise specific to the noise generated by the corresponding one of the plurality of noise sources. Element 12: wherein each noise mitigation device is associated with a corresponding one of the plurality of noise sources and each noise mitigation device associated with corresponding one of the plurality noise sources is positioned at a distance less than or equal to half of a shortest wavelength of the noise generated by the corresponding one of the plurality noise sources. Element 13: further comprising one or more passive noise attenuation techniques for attenuating part of the noise generated by the plurality of noise sources.

Element 14: wherein executing the program code further causes the computer system to detect the noise generated by the plurality of noise sources using one or more noise detection devices. Element 15: wherein a noise source of the plurality of noise sources comprises rotating equipment, the pre-determined noise spectrum pertains to a plurality of pre-determined noise spectra stored in the computer system, and each pre-determined noise spectra includes noise frequencies generated by the noise source at different rotational speeds, and wherein executing the program code further causes the computer system to: obtain a rotational speed of the noise source measured using a rotational sensor; and compare the measured rotational speed with the different rotational speeds in the noise spectrum and thereby determine a noise frequency of the noise source. Element 16: wherein executing the program code further causes the computer system to actuate the one or more noise mitigation devices that are positioned proximate each noise source such that the anti-noise generated by the one or more noise mitigation devices destructively interferes with the noise in some or all directions relative to the plurality of noise sources to thereby attenuate the noise. Element 17: each noise mitigation device is associated with a corresponding one of the plurality of noise sources, and executing the program code further causes the computer system to actuate the one or more noise mitigation devices to output anti-noise with each noise mitigation device specific to the noise generated by the corresponding one of the plurality of noise sources.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method for noise attenuation, the method comprising:

measuring a rotational speed of a noise source comprising rotating equipment using a rotational sensor, comparing the measured rotational speed with different rotational speeds in a pre-determined noise spectrum stored in a computer system;

determining a frequency of noise generated by a plurality of noise sources with a plurality of frequencies associated with the pre-determined noise spectrum and stored in the computer system, wherein the pre-determined noise spectrum pertains to a plurality of pre-determined noise spectra stored in the computer system, wherein each pre-determined noise spectra includes frequencies generated by the noise source at different rotational speeds;

identifying one or more noise sources that generate the noise based on the comparison of the frequency of the noise and the plurality of frequencies stored in the computer system;

generating anti-noise corresponding to the noise; and outputting the anti-noise using one or more noise mitigation devices associated with the one or more noise sources.

2. The method of claim 1, further comprising detecting the noise using one or more noise detection devices.

3. The method of claim 1, further comprising positioning the one or more noise mitigation devices proximate each noise source such that the anti-noise destructively interferes with the noise in some or all directions relative to the plurality of noise sources to thereby attenuate the noise.

4. The method of claim 1, wherein the plurality of noise sources comprises heavy machinery located in an open air environment.

5. The method of claim 1, wherein each noise mitigation device is associated with a corresponding one of the plurality of noise sources and outputting the anti-noise further comprises outputting anti-noise with each noise mitigation device specific to the noise generated by the corresponding one of the plurality of noise sources.

6. The method of claim 1, wherein each noise mitigation device is associated with a corresponding one of the plurality of noise sources and the method further comprises:

positioning each noise mitigation device associated with corresponding one of the plurality noise sources at a distance less than or equal to half of a shortest wavelength of the noise generated by the corresponding one of the plurality noise sources.

7. A system for noise attenuation comprising:

a plurality of noise mitigation devices for outputting anti-noise corresponding to noise generated by a plurality of noise sources; and a computer system including a non-transitory medium readable by a processor and storing computer-readable instructions that when executed by the processor configures the computer system to:

obtain a rotational speed of a noise source comprising rotating equipment measured using a rotational sensor, compare the measured rotational speed with different rotational speeds in a pre-determined noise spectrum stored in a computer system, determine a frequency of the noise with a plurality of noise frequencies associated with the pre-determined noise spectrum and stored in the computer system, wherein the pre-determined noise spectrum pertains to a plurality of pre-determined noise spectra stored in the computer system, wherein each pre-determined noise spectra includes frequencies generated by the noise source at different rotational speeds, identify one or more noise sources that generate the noise based on the comparison of the frequency of the noise and the plurality of frequencies stored in the computer system, generate the anti-noise corresponding to the noise, and actuate one or more noise mitigation devices associated with the one or more noise sources to output the anti-noise.

8. The system of claim 7, further comprising one or more noise detection devices.

9. The system of claim 7, wherein the plurality of noise mitigation devices are positioned proximate each noise source such that the anti-noise destructively interferes with the noise in some or all directions relative to the plurality of noise sources to thereby attenuate the noise.

10. The system of claim 7, wherein the plurality of noise sources comprises heavy machinery located in an open air environment.

11. The system of claim 7, wherein each noise mitigation device is associated with a corresponding one of the plurality of noise sources and the computer system actuates each noise mitigation device to output the anti-noise specific to the noise generated by the corresponding one of the plurality of noise sources.

12. The system of claim 7, wherein each noise mitigation device is associated with a corresponding one of the plurality of noise sources and each noise mitigation device associated with corresponding one of the plurality noise sources is positioned at a distance less than or equal to half of a shortest wavelength of the noise generated by the corresponding one of the plurality noise sources.

13. The system of claim 7, further comprising one or more passive noise attenuation techniques for attenuating part of the noise generated by the plurality of noise sources.

14. A computer program product embodied in a non-transitory computer-readable medium and comprising a computer readable program code that, when executed by a computer system, causes the computer system to:

obtain a rotational speed of a noise source comprising rotating equipment measured using a rotational sensor, compare the measured rotational speed with different rotational speeds in a pre-determined noise spectrum stored in a computer system, determine a frequency of noise generated by a plurality of noise sources with a plurality of noise frequencies associated with the pre-determined noise spectrum and stored in the computer system, wherein the pre-determined noise spectrum pertains to a plurality of pre-determined noise spectra stored in the computer system, wherein each pre-determined noise spectra includes frequencies generated by the noise source at different rotational speeds;

identify one or more noise sources that generate the noise based on the comparison of the frequency of the noise and the plurality of frequencies stored in the computer system;

generate anti-noise corresponding to the noise; and actuate one or more noise mitigation devices associated with the one or more noise sources to output the anti-noise.

15. The computer program product of claim 14, wherein executing the program code further causes the computer system to detect the noise generated by the plurality of noise sources using one or more noise detection devices.

16. The computer program product of claim 14, wherein executing the program code further causes the computer system to actuate the one or more noise mitigation devices that are positioned proximate each noise source such that the anti-noise generated by the one or more noise mitigation devices destructively interferes with the noise in some or all directions relative to the plurality of noise sources to thereby attenuate the noise.

17. The computer program product of claim 14, each noise mitigation device is associated with a corresponding one of the plurality of noise sources, and executing the program code further causes the computer system to actuate the one or more noise mitigation devices to output anti-noise with each noise mitigation device specific to the noise generated by the corresponding one of the plurality of noise sources.

* * * * *